US006822387B1

(12) United States Patent
Park

(10) Patent No.: US 6,822,387 B1
(45) Date of Patent: Nov. 23, 2004

(54) VACUUM FLUORESCENT DISPLAY

(75) Inventor: Kyung-Su Park, Pusan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 255 days.

(21) Appl. No.: 09/640,479

(22) Filed: Aug. 16, 2000

(30) Foreign Application Priority Data

Aug. 25, 1999 (KR) ..... 99-35472

(51) Int. Cl.[7] ..... H01J 1/62
(52) U.S. Cl. ..... 313/495; 313/422
(58) Field of Search ..... 313/491, 495–497, 313/306, 293; 345/75.2

(56) References Cited

U.S. PATENT DOCUMENTS 4,041,348 A * 8/1977 Eto et al. ..... 313/318.12
4,122,376 A * 10/1978 Mera et al. ..... 315/167
4,208,613 A * 6/1980 Hase et al. ..... 313/495
4,472,658 A * 9/1984 Morimoto et al. ..... 313/313
4,588,921 A * 5/1986 Tischer ..... 313/496
4,595,862 A * 6/1986 Morimoto et al. ..... 313/497
4,763,041 A * 8/1988 Segawa ..... 313/496
4,972,116 A * 11/1990 Tatsuda et al. ..... 313/422
4,988,913 A * 1/1991 Kawauchi et al. ..... 313/422
5,055,744 A * 10/1991 Tsuruoka ..... 315/169.1
5,463,276 A * 10/1995 Kawasaki et al. ..... 313/496
5,589,731 A * 12/1996 Fahlen et al. ..... 313/253
5,686,790 A * 11/1997 Curtin et al. ..... 313/293
5,859,508 A * 1/1999 Ge et al. ..... 315/366
6,252,349 B1 * 6/2001 Inoue et al. ..... 313/493
6,340,865 B2 * 1/2002 Kawasaki et al. ..... 313/495
2001/0008361 A1 * 7/2001 Ogawa et al. ..... 313/492

FOREIGN PATENT DOCUMENTS

CN 2232622 Y 8/1996

* cited by examiner

*Primary Examiner*—Vip Patel
*Assistant Examiner*—Glenn Zimmerman
(74) *Attorney, Agent, or Firm*—Christie, Parker and Hale, LLP

(57) ABSTRACT

A vacuum fluorescent display (VFD) capable of reducing the absorption of electrons by a control grid to enhance the functional efficiency of electrons is disclosed. The VFD has an evacuated envelope surrounded by a face glass, a base substrate and side glasses; a plurality of filamentary cathodes for emitting electrons when a negative potential is applied; an anode having a phosphor layer that responds to electrons emitted from the cathodes, and having a positive potential applied thereto; and electron control unit for generating a repulsive electric field that allows the acceleration of electrons emitted from the cathodes in the direction of the anode. The electron control unit may be a plurality of grids behind the cathodes, or a layer of transparent conductive material deposited on the inner surface of the face glass.

16 Claims, 3 Drawing Sheets

VACUUM FLUORESCENT DISPLAY

BACKGROUND OF THE INVENTION (a) Field of the Invention

The present invention relates to vacuum fluorescent displays (VFDs), and more particularly, to improvements allowing a higher efficiency of electron function to enhance the display quality.

(b) Description of the Related Art

In recent years, VFDs, utilizing phosphor display elements to form a viewed alphanumeric or graphic image, have come into wide use as displays in electronic and electrical appliances.

A typical vacuum fluorescent display device comprises a transparent evacuated envelope containing a plurality of anodes arranged in a pattern of desired light emission, each anode being coated with a fluorescent layer for emitting light when excited, a heated filament serving as a source of electrons, and control grids located between the filament and the anodes for determining which anodes can be excited by the electrons. When the anodes and the control grids are at a high voltage and the filament is at a lower voltage the electrons can excite the phosphor layer on the anodes to cause light emission from the anodes.

Referring to FIG. 5, a conventional VFD will be described. An evacuated envelope is sealed with a face glass 2, a base substrate 4 and side glasses 6. The base substrate 4 comprises a wiring layer (not shown) covered with an insulating layer 8. A conducting layer 12 (anode) is formed on the insulating layer 8 and is provided with a positive potential through a conducting wire 10. A phosphor layer 14 is deposited on the conducting layer 12.

A plurality of filamentary cathodes 18 is located in the envelope spaced from the anode 12 and is heated to thermionically emit the electrons. Control grids 16 are located between the anode 12 and the cathode 18 to accelerate the emitted electrons.

In the VFD shown in FIG. 5, or other similar triode vacuum tubes, the filament is heated, such as by an AC current, to a temperature at which it will emit electrons. The control grids, biased at a positive potential, accelerate electrons emitted from the filament toward the anode, which is also biased higher than the filament. On the anode, the phosphor layer emits light in response to the bombardment by electrons emitted from the filament and accelerated by the control grid to the anode.

Since only those electrons that pass through a positive control grid can reach the anode, some electrons that do not pass are absorbed by the control grid. That is, since only some of the emitted electrons impinge on the phosphor layer for lighting, the efficiency of electron function is not optimal, and this results in a degradation of the brightness of the display.

Further, when the control grids are hit by the electrons, they may be heated by additional currents and suffer thermal deformation. Even if the spaces between grids are partially shifted, stains or spots on the display pattern will result.

Because the control grids as well as the anode are formed on the base substrate, the design of VFDs may be restricted by space availability. The components comprising grids and anodes are formed on the base substrate, and it subsequently takes a long time to manufacture a VFD.

SUMMARY OF THE INVENTION

In view of the prior art described above, it is an object of the present invention to provide a vacuum fluorescent display capable of reducing the absorption of electrons by a control grid to enhance the efficiency of emitted electrons.

It is another object of the present invention to provide an improved vacuum fluorescent display having enhanced brightness and higher display quality.

To achieve these objects, as embodied and broadly described herein, the invention comprises

- an evacuated envelope surrounded by a pair of substrates and side glasses;
- a plurality of filamentary cathodes for emitting electrons when a negative potential is applied; and
- a display unit, provided on one of the substrates in the evacuated envelope, having a positive potential applied thereto, and displaying a predetermined image in response to the electrons emitted from the plurality of filamentary cathodes;
- an electron control unit for generating a repulsive electric field to allow acceleration of the electrons emitted from the plurality of filamentary cathodes in the direction of the display unit.

A negative potential is applied to the electron control unit. The electron control unit may be a plurality of grids that are shaped as a mesh, or it may be a layer of a transparent electrically conductive material such as tin doped indium oxide (ITO) deposited on the other substrate.

According to another aspect of the present invention, a VFD further comprises a control electrode, located around the electron emissive means, for controlling the trajectories of the electrons emitted from the electron emissive means.

Both the foregoing general description and the following Detailed Description are exemplary and are intended to provide further explanation of the invention as claimed.

BRIEF DESCRIPTION OF THE DRAWINGS

The accompanying drawings provide a further understanding of the invention and, together with the Detailed Description, explain the principles of the invention. In the drawings.

DETAILED DESCRIPTION OF THE PREFERRED EMBODIMENTS

The present invention will be described in detail with reference to the accompanying drawings.

Figure 1:
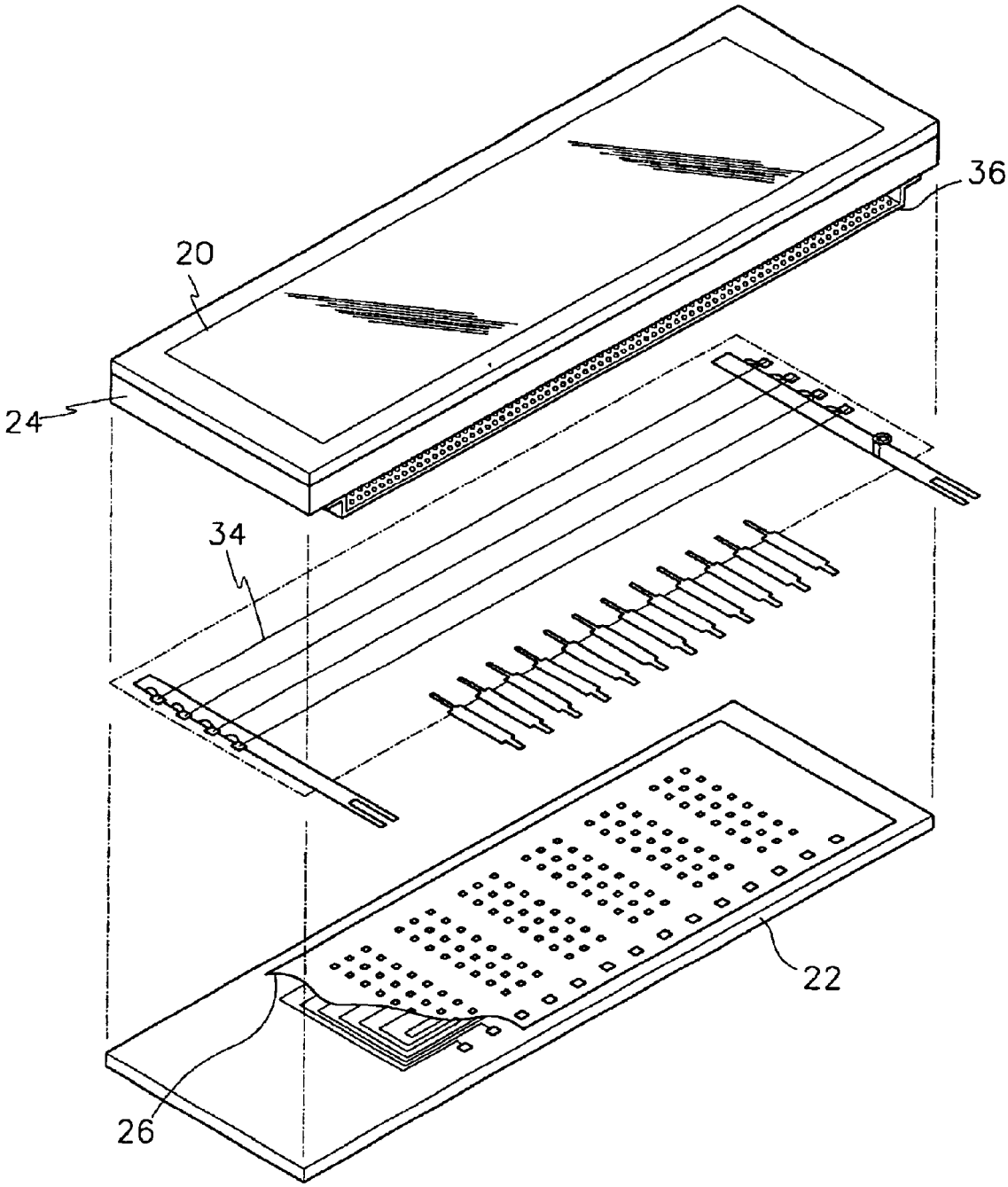
FIG. 1 shows an exploded projection of a vacuum fluorescent display according to a first preferred embodiment of the present invention.
Figure 2:
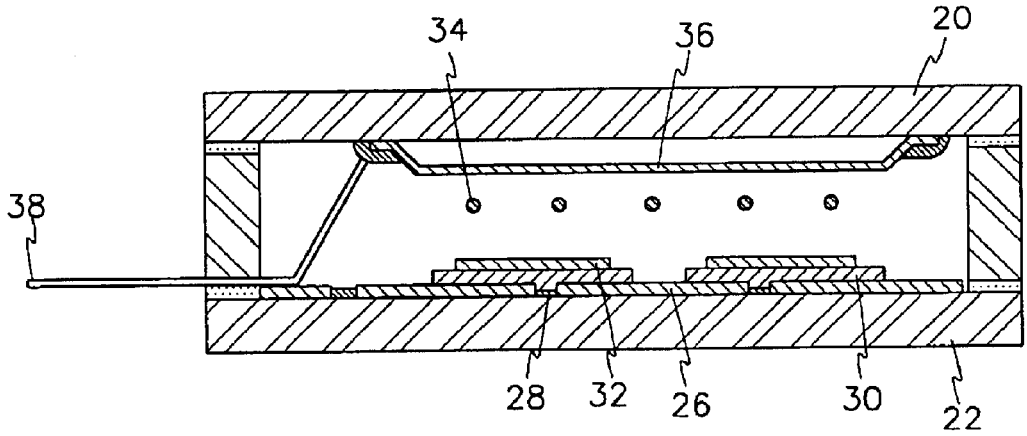
FIG. 2 shows a cross section of a vacuum fluorescent display according to the first preferred embodiment of the present invention.

Referring to FIGS. 1 and 2, an evacuated envelope of a VFD according to the present invention is sealed with a face glass 20, a base substrate 22 and side glasses 24. The base substrate 22 comprises a wiring layer (not shown) covered with an insulating layer 26. A conducting layer 30 is formed on the insulating layer 26 and provided with a positive potential by a through hole 28. The conducting layer 30 functions as an anode. A phosphor layer 32 such as is ZnO:Zn, which is fluorescent at low voltages, is deposited on the conducting layer 30, thereby forming display areas.

A plurality of filamentary cathodes 34 (referred to as filaments hereinafter) are located in the envelope with the conducting layer 30 and heated to thermionically emit electrons. Each filament, which comprises a tungsten core coated with oxides of barium, strontium and potassium, is suspended by supporting members (not shown).

An electron control unit is located between the face glass 20 and the filament 34, to accelerate the emitted electrons to the conducting layer 30 and phosphor layer 32 through application of a negative potential. According to a first preferred embodiment of the present invention, the electron control unit is a plurality of grids 36.

Electrons emitted from the filament 34 are repelled from the grids 36, then accelerated to the conducting layer 30 because of the negative potential applied to the grids 36.

A conducting member 38 bends elastically into the grids 36 from the base substrate 22, and applies the negative potential to the grids 36. A positive potential is applied to the conducting layer 30, similar to the prior art, and further descriptions thereof will not be made.

In the VFD shown in FIGS. 1 and 2, the filament 34 is heated, by an AC current for example, to a temperature at which it will emit electrons. The grids 36 are biased at a negative potential to accelerate electrons emitted from the filament 34 toward the anode. The grids 36 are preferably biased at a lower voltage than the filament. On the conducting layer 30, the phosphor layer 32 emits light in response to the bombardment by electrons emitted from the filament 34 and accelerated by the grids 36.

In order to accelerate the electrons, the electron control unit according to the present invention repels electrons by a negative potential from behind the filament while the control grids of prior art attract electrons by a positive potential from in front of the filament. Therefore, a VFD according to the present invention may increase the functional efficiency of the emitted electrons, resulting in improvement of the brightness of the display.

Figure 3:
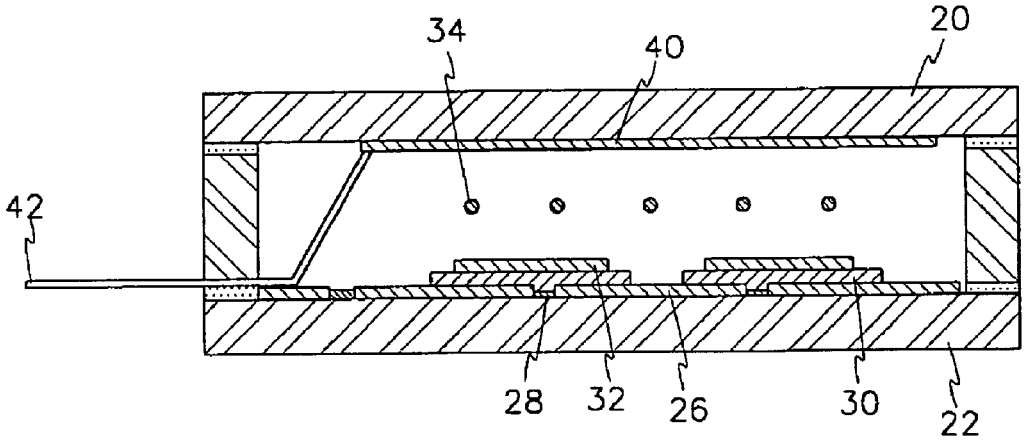
FIG. 3 shows a cross section of a vacuum fluorescent display according to a second preferred embodiment of the present invention.

Referring now to FIG. 3, a second embodiment of the present invention will be explained. The same reference numerals indicate the same elements as FIG. 2. As the description of the conducting layer 30, phosphor layer 32 and filament 34 is similar to that of the first preferred embodiment, further descriptions thereof will not be made.

An electron control unit of this second embodiment is a layer of a transparent electrically conductive material 40 which is deposited on the inner surface of the face glass 20 to act as an electrode. The transparent conductive material may be tin doped indium oxide (ITO) or similar materials. A negative potential is applied to the transparent conductive layer 40, which accelerates the emitted electrons to the conducting layer 30 and phosphor layer 32. The layer 40 of the transparent conductive material such as ITO may be less expensive to produce than grids as in the first embodiment.

Electrons emitted from the filament 34 are repelled from the transparent conductive layer 40 and accelerated to the conducting layer 30 because of the negative potential applied to the layer 40.

A conducting member 42 bends elastically into the layer 40 from the base substrate 22, and applies the negative potential to the layer 40.

Figure 4:
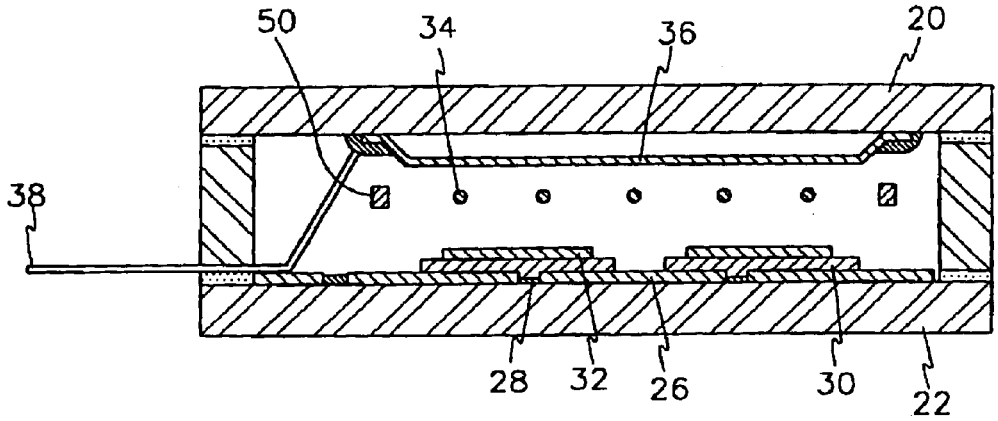
FIG. 4 shows a cross section of a vacuum fluorescent display according to a third preferred embodiment of the present invention.
Figure 5:
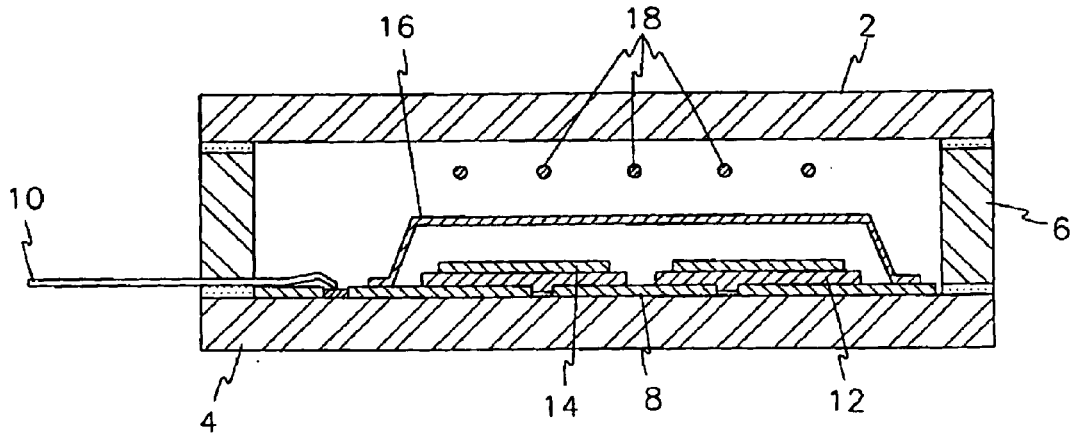
FIG.5 (Prior Art)
FIG. 5 shows a cross section of a prior art vacuum fluorescent display.

Referring now to FIG. 4, a third embodiment of the present invention will be explained. The same reference numerals indicate the same elements as in FIG. 2. A vacuum fluorescent display according to the third embodiment further comprises control electrodes 50 located around the filament 34. The control electrodes 50 are capable of controlling the diffusion or the trajectories of the emitted electrons.

It is possible to apply either a positive potential or a negative potential to the control electrodes 50, as needed. When the emitted electrons go beyond the display areas, a negative potential may be applied to the control electrodes 50 to gather the electrons into the display areas. When the emitted electrons converge locally in the display areas, a positive potential may be applied to the control electrodes 50 to diffuse the electrons uniformly. Therefore, the use of the control electrodes enhances the functional efficiency of the electrons, and minimizes bright spots around the display area.

Further, it is possible to provide control electrodes in the second embodiment although it is not shown in the drawing. That is, control electrodes may be provided around the filament in the case that the electron control unit is a transparent conductive layer such as an ITO layer deposited on the inner surface of the face glass. A negative potential applied to the ITO layer accelerates electrons emitted from the filament while either a positive or negative potential applied to the control electrodes controls the trajectories of the electrons.

As explained above, a VFD according to the present invention does not have any obstacles in the electron path to an anode, so most of the electrons emitted from a filament can, reach the anode. Further, the electrons are accelerated by an electron control unit and uniformly diffused by control electrodes in the VFD, so brightness as well as display quality is much improved.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A vacuum fluorescent display comprising:

a pair of substrates and side glasses surrounding an evacuated envelope;

an electron emissive means for emitting electrons when a first negative potential is applied thereto;

a display means provided on one of the substrates in the evacuated envelope for receipt of a positive potential applied thereto, and for displaying a predetermined image in response to electrons emitted from the electron emissive means; and an electron control means for generating a repulsive electric field when a second negative potential is applied thereto to accelerate electrons emitted from the electron emissive means in the direction of the display means, wherein the electron emissive means is located between the display means and electron control means and wherein the second negative potential is lower than the first negative potential.

2. The vacuum fluorescent display as recited in claim 1, wherein the electron control means is mounted on the substrate.

3. The vacuum fluorescent display as recited in claim 2, wherein a negative potential is applied to the electron control means.

4. The vacuum fluorescent display as recited in claim 1, wherein the electron control means is a plurality of grids which are shaped as a mesh.

5. The vacuum fluorescent display as recited in claim 1, wherein the electron control means is a layer of a transparent electrically conductive material.

6. The vacuum fluorescent display as recited in claim 5, wherein the transparent electrically conductive material is tin doped indium oxide.

7. The vacuum fluorescent display as recited in claim 1, further comprising control electrode means, located near the electron emissive means, for control of trajectories of electrons emitted from the electron emissive means.

8. The vacuum fluorescent display as recited in claim 7, wherein either a positive or negative potential is applied to the control electrode means.

9. A method of producing an image on a vacuum fluorescent display, comprising:

providing a vacuum fluorescent display having an evacuated envelope enclosed by two substrates and side glasses, a display means provided on one of the substrates in the evacuated envelope, an electron control means, and an electron emissive means located between the display means and electron control means;

applying a first negative potential to the electron emissive means to emit electrons;

applying a positive potential to the display means to attract the emitted electrons; and applying a second negative potential to the electron control means to repel and accelerate the emitted electrons toward the display means, wherein the second negative potential is lower than the first negative potential.

10. The method of claim 9 wherein the vacuum fluorescent display further comprises a control electrode, the method further comprising applying a potential to the control electrode to control the trajectory of the emitted electrons.

11. A vacuum fluorescent display comprising:

a pair of substrates and side glasses surrounding an evacuated envelope;

a display provided on one of the substrates in the evacuated envelope;

an electron controller including a plurality of grids, to accelerate electrons toward the display when a second negative potential is applied thereto; and an electron emitter located between the display and electron controller for emitting electrons when a first negative potential is applied thereto, wherein the second negative potential is lower than the first negative potential.

12. The vacuum fluorescent display as recited in claim 11, wherein the electron controller is mounted on the substrate.

13. The vacuum fluorescent display as recited in claim 11 wherein the electron controller is shaped as a mesh.

14. The vacuum fluorescent display as recited in claim 11, wherein the electron controller is a layer of a transparent electrically conductive material.

15. The vacuum fluorescent display as recited in claim 14, wherein the transparent electrically conductive material is tin doped indium oxide.

16. The vacuum fluorescent display as recited in claim 11, further comprising a control electrode located near the electron emitter to control trajectories of emitted electrons.

* * * * *